United States Patent [19]

Boni

[11] 3,965,498

[45] June 29, 1976

[54] FOLDING BED ASSEMBLY

[76] Inventor: Miklos Boni, 20717 Vanowen St., Apt. 18, Canoga Park, Calif. 91306

[22] Filed: June 20, 1975

[21] Appl. No.: 588,794

[52] U.S. Cl. ..... 5/6; 5/159 R; 5/332

[51] Int. Cl.[2] ..... A47C 13/38

[58] Field of Search ..... 5/6, 159 R, 174, 332

[56] References Cited

UNITED STATES PATENTS

| | | | |
|---|---|---|---|
| 1,799,437 | 4/1931 | O'Dell | 5/332 |
| 2,544,762 | 3/1951 | Lochridge | 5/6 |
| 2,788,528 | 4/1957 | Hausen | 5/6 |
| 3,638,249 | 2/1972 | Katsigarakis | 5/6 |

*Primary Examiner*—Casmir A. Nunberg
*Attorney, Agent, or Firm*—John J. Posta, Jr.

[57] ABSTRACT

The improved assembly includes a bed having a bed frame, preferably generally rectangular and formed of interconnected head, foot and side boards, as well as folding means such as hinges extending therethrough, which permit the frame to be folded upon itself. The bed also includes a foldable mattress within the frame and support means such as bed springs below the mattress. The frame is disposed above the ground on foldable legs, and one or more foldable side tables with foldable legs may form part of the frame. A storage cabinet having doors opening an enclosed bed storage space is also provided and is connected to the bed through at least one simple elongated lever arm, one end of which is pivotably connected to the frame sideboard adjacent the headboard or to the headboard itself and the other end of which is connected to a sidewall or rear wall of the cabinet within the storage space. When the bed is folded upon itself and then pushed toward the storage space, the head end of the bed travels up and into the storage space, the bed reaching a vertical storage position for maximum compactness. The assembly is therefore simple, inexpensive and occupies a minimum of space.

7 Claims, 8 Drawing Figures

FOLDING BED ASSEMBLY

BACKGROUND OF THE INVENTION

A. Field of the Invention

The present invention generally relates to beds and more particularly to folding beds.

B. Description of Prior Art

The so-called "in-a-door" beds found in many small apartments comprise beds which usually swing up into a vertical posture without folding. They usually are connected to hinge means secured in a storage space behind a full length door and have certain drawbacks. Thus, many of such beds are heavy and it requires considerable effort to literally lift their foot ends into a vertical place and thus into the storage space behind the full length door opening onto said space. Moreover, in many instances, one sleeps on the bed with his head well within the storage space, an inconvenience both aesthetically and psychologically. Those of such beds which slide out of their storage space usually do so on unsightly tracks. Moreover, the full length door covering the in-a-door bed is usually an eye sore. Such beds have the further disadvantage or requiring an area having as much as 7 feet of height, so that they are not suitable in areas with lowered ceilings and the like.

There have been efforts in the past to overcome the described disadvantages of in-a-door beds by providing beds which fold up before they are stored. However, most such beds are of the temporary "cot" type with inadequate springing, unsightly appearance, etc. Moreover, they usually must be moved by hand, with some difficulty, from their point of use to their storage area, militating against their continued use.

Certain permanent type folding beds have also been provided in assemblies which include decorative storage cabinets. Such assemblies have met with approval since they eliminate most of the previously described disadvantages. However, many of such assemblies are very expensive, employ complicated mechanisms and require considerable effort to move the bed thereof between a functioning and a storage position. Accordingly, there still is a need for a simple, inexpensive folding bed assembly which can be moved to and from storage with a minimum amount of effort and which provides a maximum of aesthetic appeal.

SUMMARY OF THE INVENTION

The improved folding bed assembly of the present invention satisfies the foregoing needs. It is substantially as set forth in the Abstract above. Thus, the assembly is relatively simple to make, use and maintain and employs easily available components. It includes the described foldable frame, mattress, folding means, storage cabinet and simple elongated lever arm pivotably interconnecting the head of the frame and a wall of the cabinet in the cabinet storage space. The lever arm is so arranged that by pushing the bed (when folded) towards the storage space, with a minimum of effort, the head of the bed is pivoted up by the lever arm and the folded bed easily and quickly assumes a vertical posture in the storage space. Thus, the storage space can be made relatively low and of shallow depth, but still can easily store the bed. The bed is just as easily moved out of the storage space by pulling it away from the space, the weight of the bed helping it to move itself into horizontal alignment, so that it then need only be unfolded and it is ready for use. The bed frame preferably is provided with a plurality of spaced foldable braceable support legs as well as one or more foldable side tables with foldable legs, all capable of being moved into and out of operative position easily and effectively. The cabinet may be relatively low and shallow and may include one or more decorative doors covering the storage space, as well as storage drawers, shelves and the like. It can easily be made to resemble a conventional decorative bureau, cabinet or the like for maximum appeal. Further features of the invention are set forth in the following detailed description and accompanying drawings.

DRAWINGS

DETAILED DESCRIPTION OF THE PREFERRED EMBODIMENT

FIGS. 1–7

Figure 1:
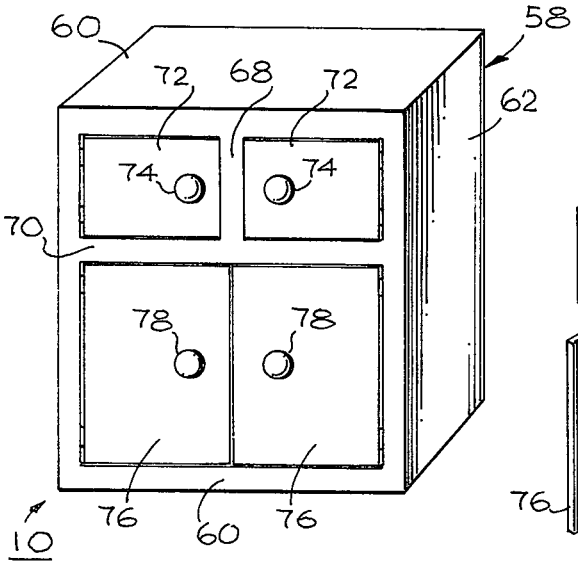
FIG. 1 is a schematic perspective view of a preferred embodiment of the improved folding bed assembly of the present invention, showing the cabinet thereof in a closed position.

Now referring more particularly to the drawings, a preferred embodiment of improved folding bed assembly of the present invention is schematically depicted in FIGS. 1 through 7. Thus, in FIG. 3, assembly 10 is shown which includes a bed 11 having a generally rectangular bed frame 12 comprised of a raised headboard 14, a foot board 16 and interconnecting spaced sideboards 18. Frame 12 is foldable, being provided transverse thereof at about the midpoint of its length, with folding means in the form of hinges 20 joining the two halves of each sideboard 18. Hinges 20 are positioned so that the lower foot half 22 of frame 12 can be folded to overlie the upper head half 24 of frame 12, with footboard 16 against or near surface 26, that is, the bed-facing surface, of headboard 14, as shown particularly in FIG. 5. Frame 12 can be made of, for example, flat pieces of wood, metal, plastic or the like.

Figure 3:
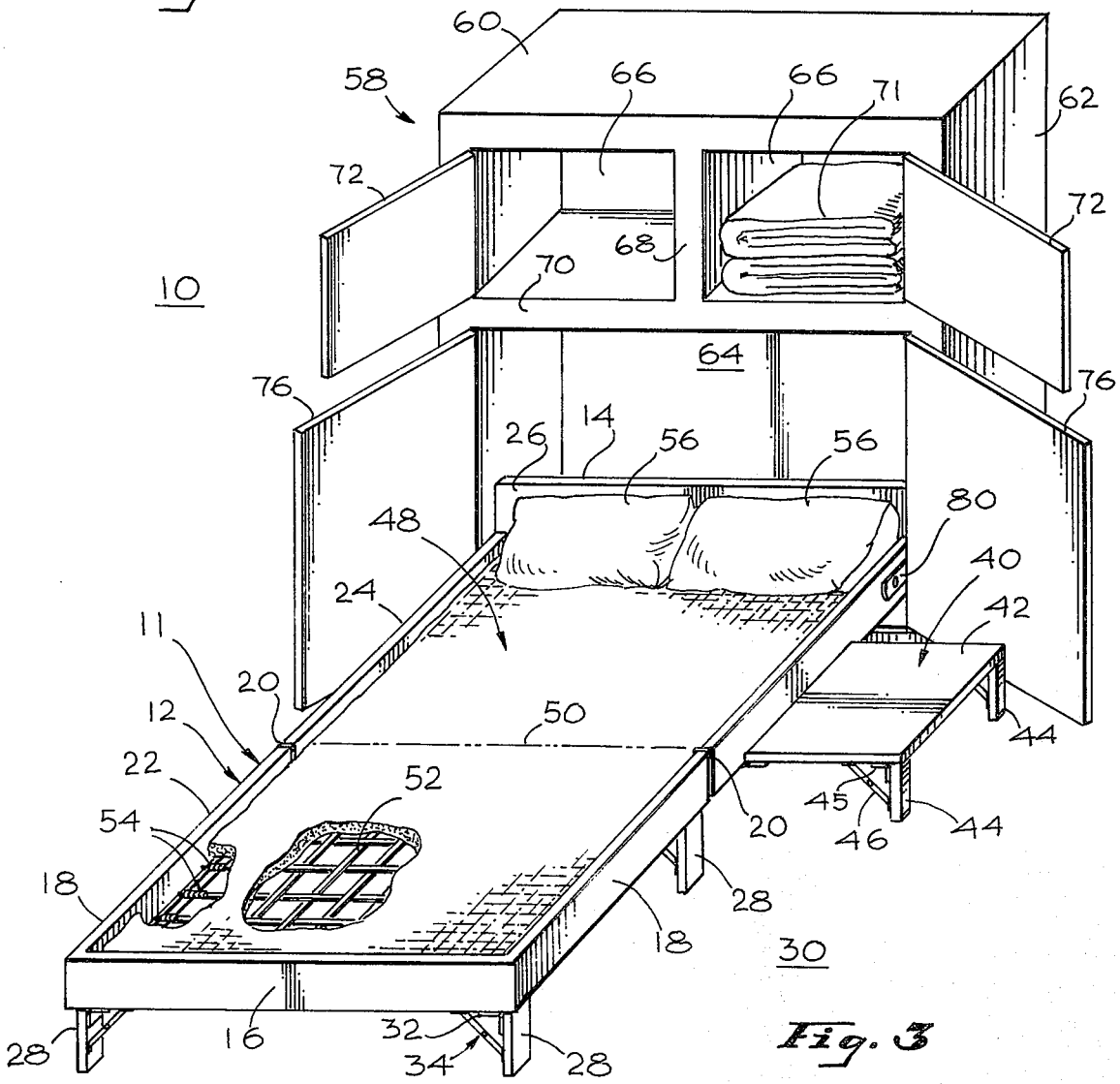
FIG. 3 is a schematic perspective view of the assembly of FIG. 1 and 2, but with the bed thereof in a fully operative position, portions of said bed being broken away to illustrate certain internal features thereof.
Figure 6:
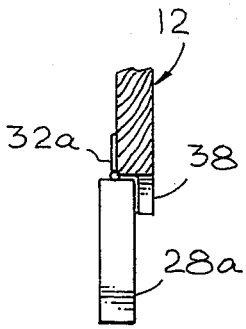
FIG. 6 is a schematic, enlarged fragmentary front elevation of a second embodiment of one of the legs of the frame of the present assembly, showing the manner of interconnection of the leg and frame.

Frame 12 preferably includes, as shown in FIG. 3, a plurality of, for example, 6 spaced legs supporting frame 12 on floor 30. Legs 28 depend from and are foldable inwardly, that is, towards frame 12, being provided with hinges 32 and detent means 34, the latter preventing the movement of legs 28 to a position lateral of frame 12. Means 34 may comprise a foldable pair of hingedly interconnected struts or braces 34 of conventional design. Alternatively, as shown in FIG. 6, one or more legs 28*a* may be secured to the lower edge of frame 12, as by a hinge 32*a*. Detent means 34ain the form of a strip 38 depending from frame 12 prevents leg 28*b* from being moved to a position lateral of frame 12.

Frame 12 preferably also includes one or more folding side tables 40, each of which may comprise a table top 42 connected via hinges 43 to frame 12, and a plurality of spaced foldable legs 44 provided with hinges 45 and detents 46, such as struts 47, of the same construction and function as the detents 34. Side table 40 provides a maximum of convenience, appeal and decor and can easily be placed in an operative position or neatly folded when it is desired to store bed 11. Legs 28 as well as table(s) 40 can be made of any suitable material such as wood, metal, plastic or the like.

Bed 11 further includes a mattress 48 readily foldable upon itself along fold line 50 (if any). Mattress 48 may be made of any suitable resilient, readily foldable material such as natural or synthetic foam rubber, cellulosic material with cloth covering, etc. Mattress 48 is disposed within frame 12 and is supported on a resilient web of, for example, wire, cloth strips, etc. which preferably is secured to sideboards 18, as by springs 54 or the like. Bed 11 may also include one or more conventional pillows 56.

Assembly 10 also includes a cabinet 58 of decorative wood, metal, plastic or the like, comprising top, bottom and front and rear end walls 60 interconnected with sidewalls 62 to define a lower bed storage space 64 and an upper pair of storage compartments 66 separated from each other and from space 64 by dividers 68 and 70, and suitable for storage of materials such as blanket 71. Each compartment 66 is fitted with a hinged door 72 and a handle 74 (FIGS. 1 and 5).

Figure 2:
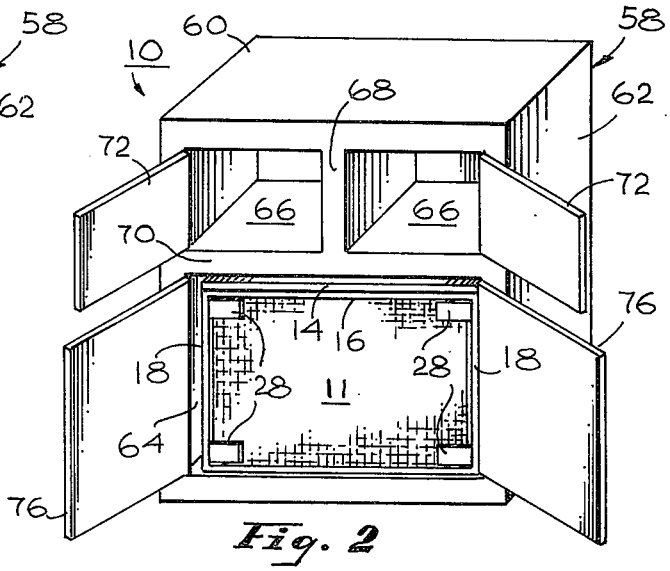
FIG. 2 is a schematic perspective view of the assembly of FIG. 1, with the cabinet doors open, a portion of the stored bed thereof being broken away to illustrate certain internal features thereof.
Figure 5:
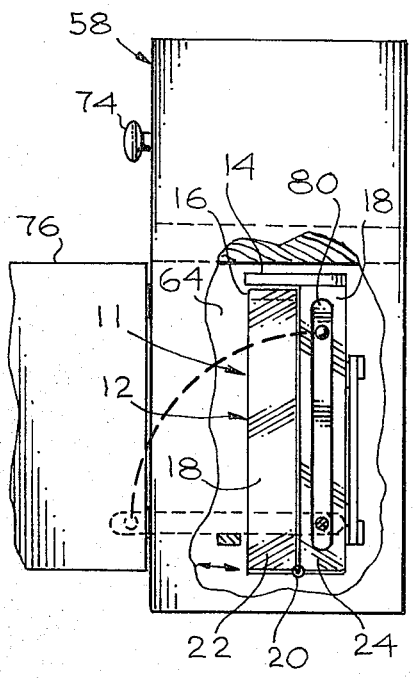
FIG. 5 is a schematic side elevation of the assembly of FIG. 2 with the bed thereof fully stored, portions being broken away to illustrate certain internal features thereof.
Figure 7:
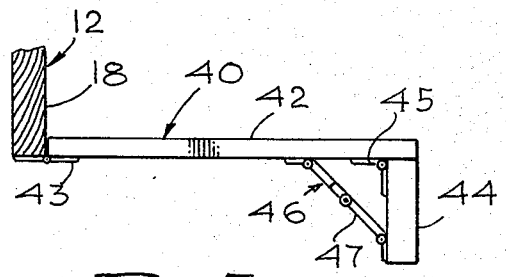
FIG. 7 is an enlarged schematic front elevation of the end table of the assembly of FIG. 3, showing the manner of interconnection of the end table with the frame; and, FIG. 8 is a schematic side elevation of the assembly of the present invention, depicting an alternative manner of interconnection, via the lever arm, of the frame and cabinet of the assembly.

Space 64 is covered by a pair of hinged doors 76 and handles 78 (FIGS. 1 and 5). Space 64 can be relatively low and shallow because when bed 11 is folded and placed in a vertical position, it is relatively low and shallow (FIGS. 2 and 5).

Figure 4:
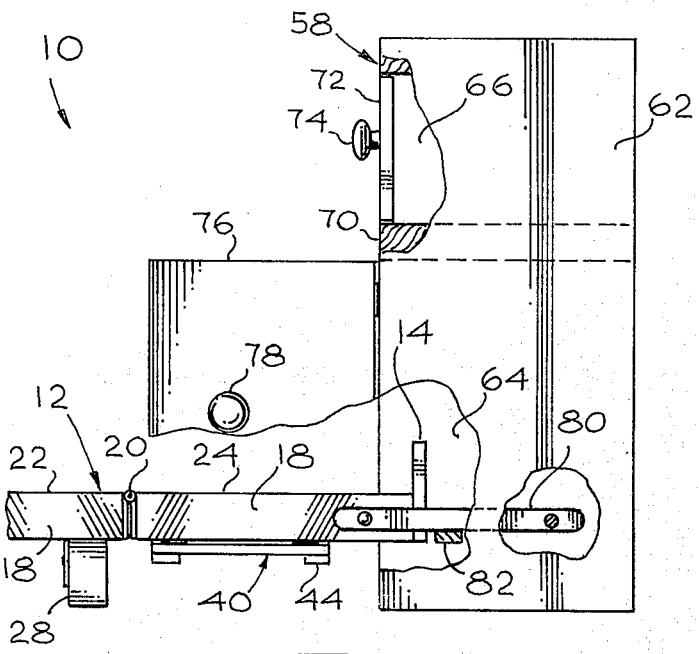
FIG. 4 is a schematic side elevation of the assembly of FIG. 3 with the bed thereof fully deployed, portions being broken away to illustrate certain internal features thereof.

Assembly 10 further includes at least one, simple, flat, elongated lever arm 80 of steel or the like, one end of which is pivotably secured within space 64 to one of the walls, such as sidewall 62, defining space 64 and the other end of which is pivotably secured to frame 12, adjacent headboard 14, such as to sideboard 18, as shown in FIGS. 3, 4 and 5. Preferably, a pair of such arms 80 are provided, connected to sidewalls 62 and adjacent sideboards 18, as shown in FIGS. 3, 4 and 5. Each arm 80, when fully extended through the front of cabinet 58, is preferably generally horizontal and at about the level of frame 12, as shown in FIGS. 3 and 4. A detent 82 is provided in wall 62 and intercepts arm 80 so as to prevent it dropping below horizontal.

When it is desired to store bed 11, table(s) 40 and legs 44 are folded, whereupon frame 12, with mattress 48 in place, is folded upon itself. Legs 28 are also folded. The folded bed is then urged toward space 64 so that the end of arm 80, which is connected to frame 12, pivots up and towards space 64, carrying frame 12 with it. Thus, frame 12 rises and moves into space 64 with headboard 14 at the top and folded bed 11 aligned vertically, as shown in FIG. 5. The arc described by the head of bed 11 is shown in dotted outline. Bed 11 thus is very simple, efficiently and rapidly moved with a minimum of effort into the stored position of FIG. 5, no complicated mechanism and no unsightly rails or tracks being needed.

Doors 76 can then be closed to completely conceal bed 11. The assembly 10 thereupon has the attractive appearance shown in FIG. 1.

Bed 11 is just as easily moved out of cabinet 58 by opening doors 76 and then by urging bed 11 away from cabinet 56. Gravity aids in easily bringing bed 11 into a horizontal position, from which it can easily be unfolded and legs 28 can be deployed, as well as table 40 and legs 44, as desired. Bed 11 thus is rapidly and simply made ready for use.

FIG. 8

Figure 8:
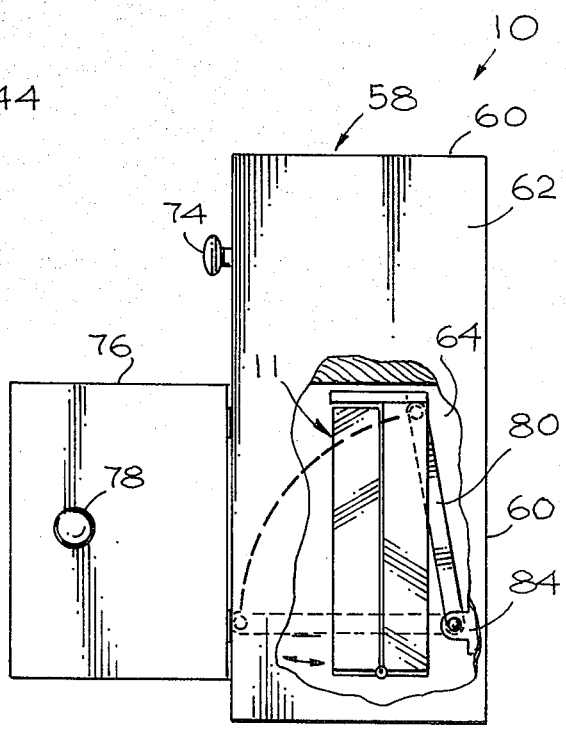

An optional modification in linkage between bed 11 and cabinet 58 is schematically shown in FIG. 8. The modification is effected by pivotably connecting one end of arm 80 to a rear end wall 60, in cabinet 58, as by a bracket 84, and pivotably connecting the opposite end of arm 80 to the center rear surface of headboard 14, as shown in FIG. 8, so that only one arm 80 is needed to perform the previously described functions smoothly. It will be understood that this manner of linkage requires some minor modification of length of components, etc.

Various other modifications, changes, alterations and additions can be made in the present assembly and in its components. All such modifications as are within the scope of the appended claims form part of the present invention.

What is claimed and desired to be secured by Letters Patent is:

1. An improved folding bed assembly, said assembly comprising, in combination:

a bed frame having an upper portion and a lower portion, hinge means interconnecting said upper portion and said lower portion, a mattress supported by said bed frame and adapted to be foldable thereon, a storage cabinet having interconnected side walls, at least one elongated lever arm, one end of said level arm being pivotally connected to a first side of said upper portion of said bed frame near the top thereof, the opposite end of said lever arm being pivotally connected to the rear, lower end of one of said side walls, said lever arm extending generally horizontally at about the level of said bed frame when said bed frame is in an operative position, whereby the lower portion of the bed frame is adapted to be folded over the upper portion of said bed frame with the folded mattress therebetween to result in a compacted bed assembly having about one half the length of the bed frame in its operative position, wherein said compacted bed assembly is adapted to be moved into a substantially vertical position and located between said side walls by movement of one end of said level arm upward and towards said walls in an arcuate path extending about the pivot point of the opposite end of said lever arm and said one of said side walls, whereby said bed assembly is stored between said side walls.

2. The improved folding bed assembly of claim 1 wherein a spaced pair of said arms are pivotably secured to said opposed side boards, one to each sideboard, and to opposed sidewalls of said cabinet.

3. The improved folding bed assembly of claim 1 wherein one end of said arm is pivotably secured to the rear wall of said cabinet and the other of said arms is pivotably secured to said headboard.

4. The improved folding bed assembly of claim 1 wherein said folding means includes hinge means disposed transverse of said frame at about the midpoint thereof, whereby about one half of said frame is foldable upon the remainder of said frame.

5. The improved folding bed assembly of claim 4 wherein said frame includes a plurality of spaced inwardly foldable legs and detent means restricting outward movement of said legs and wherein said bed includes a foldable support disposed below said mattress within said frame.

6. The improved folding bed assembly of claim 5 wherein said frame includes at least one foldable side table bearing a plurality of spaced inwardly foldable legs and detent means restricting outward movement of said legs.

7. The improved folding bed assembly of claim 1 wherein said cabinet includes a pair of doors connected to said walls adapted to close off from view the bed assembly when it is located within said cabinet.

* * * * *